United States Patent [19]

Fudatsuji et al.

[11] 4,451,165

[45] May 29, 1984

[54] INK RIBBON FOLDING MECHANISM FOR A PRINTING APPARATUS

[75] Inventors: Toshiharu Fudatsuji; Tsutomu Imagi; Hiroshi Miura, all of Kawasaki, Japan

[73] Assignee: Fujitsu Limited, Kawasaki, Japan

[21] Appl. No.: 504,090

[22] PCT Filed: Dec. 11, 1980

[86] PCT No.: PCT/JP80/00304

§ 371 Date: Jul. 31, 1981

§ 102(e) Date: Jul. 31, 1981

[87] PCT Pub. No.: WO81/01685

PCT Pub. Date: Jun. 25, 1981

Related U.S. Application Data

[63] Continuation of Ser. No. 287,751, Jul. 31, 1981, abandoned.

[30] Foreign Application Priority Data

Dec. 12, 1979 [JP] Japan ..... 54-161033

[51] Int. Cl.[3] ..... B41J 32/02

[52] U.S. Cl. ..... 400/196.1; 400/234; 400/208

[58] Field of Search ..... 400/196.1, 195, 234, 400/248.1, 208

[56] References Cited

U.S. PATENT DOCUMENTS 4,227,820 10/1980 Falcetti ..... 400/196.1

4,243,334 1/1981 Shigemeri ..... 400/196.1

4,343,556 8/1982 Kobayashi ..... 400/196.1

FOREIGN PATENT DOCUMENTS 2412762 11/1974 Fed. Rep. of Germany ... 400/196.1

2550305 5/1977 Fed. Rep. of Germany ... 400/196.1

2368365 6/1978 France ..... 400/196.1

OTHER PUBLICATIONS

Dowd, *Mobius Guide,* IBM Technical Disclosure Bulletin, vol. 20, No. 6, p. 2175, 11/77.

*Primary Examiner*—William Pieprz

*Attorney, Agent, or Firm*—Staas & Halsey

[57] ABSTRACT

An ink ribbon folding mechanism for a printing apparatus is adapted for folding an endless ribbon (3) in a ribbon case (6) by means of a pair of feed rollers (4, 4'; 4A, 4A'). For achieving a smooth folding of the ink ribbon, in spite of the relative roughness of the surface (12) of the ink ribbon which is subjected to collision with the type compared to the relative smoothness of the other surface (13), the contact point (17) of the feed rollers is located in a biased position with respect to the center (18) of the ribbon case so that the contact point is closer to the side wall (**6*b*) of the ribbon case that faces the smooth surface of the ink ribbon than to the side wall (6*a*) of the ribbon case that faces the rough surface of the ink ribbon, whereby, even though when being folded on the side of the smooth surface, the ink ribbon can reach a side wall (6*b***) of the ribbon case that faces the smooth side of the ink ribbon.

3 Claims, 14 Drawing Figures

INK RIBBON FOLDING MECHANISM FOR A PRINTING APPARATUS

This application is a continuation of application Ser. No. 287,751, filed July 31, 1981, which arose from International Application PCT/JP80/00304, filed Dec. 11, 1980 now abandoned.

BACKGROUND OF THE INVENTION

The present invention relates to a printing apparatus and, more specifically, to an ink ribbon facing mechanism, in which an endless ink ribbon is folded regularly and contained in a ribbon case.

Ink ribbons having a width of several centimeters or less have been used hitherto for low-speed and small-sized typewriters or serial printers, but, recently, they are also being used for middle-speed line printers.

There is a known ink ribbon folding mechanism for a printing apparatus using the above-mentioned type of ink ribbon, which mechanism comprises a ribbon case provided with an inlet and an outlet at opposed ends for an ink ribbon, and a pair of feed rollers disposed at said inlet of the ribbon case, said feed rollers having parallel axes of rotation and being in contact with each other at their peripheries, whereby an endless ink ribbon, which has been passed through the outlet of the ribbon case and a printing station, is pinched between the feed rollers and fed into the ribbon case alternately along the peripheries of the feed rollers so as to be folded regularly by lengths reaching the opposed side walls of the ribbon case.

This known mechanism, however, has a problem which will be described with reference to FIGS. 1 through 3 in the accompanying drawings. FIG. 1 diagrammatically illustrates a conventional line printer with the above-described type of ink ribbon folding mechanism. In this line printer, a type belt 1 is run by means of pulleys 2 and 2', and an endless ink ribbon 3 is passed along the outside of the type belt 1 and drawn by a pair of feed rollers, including a driving roller 4 and a driven roller 4', in the direction of arrow 5, so as to be fed into a ribbon case 6. The ink ribbon 3 is fed into the ribbon case 6 alternately along the peripheries of the feed rollers 4 and 4' so as to be folded regularly by lengths reaching the opposed side walls **6*a* and 6*b* (FIGS. 2 and 3) of the ribbon case 6, and advanced in order toward the interior. The ink ribbon 3 contained in the ribbon case 6 in such way is taken out of an outlet 7 of the ribbon case and fed along the type belt 1 again via guide rollers 8. Furthermore, a printing hammer 9 is arranged opposite to the type belt 1, and a printing paper 10 is passed between the printing hammer 9 and the ink ribbon 3, so that the printing hammer 9 causes the ink ribbon 3 and the paper 10 to be struck on the type belt 1, whereby the printing is performed. On the inner side of the type belt 1, a platen 11 is provided for stopping the impact of the printing hammer 9**.

When the printing is continuously performed as mentioned above, a surface 12 of the ink ribbon 3 which faces the type belt 1 is struck against the printing types and, accordingly, becomes nappy and rough. Contrary to this, the opposite surface 13 of the ink ribbon 3 is struck by the printing paper 10 and, accordingly, becomes smooth. Therefore, one surface 12 of the ink ribbon 3 becomes a rough surface and the opposite surface 13 of the same becomes a smooth surface. As a result, a phenomenon arises, which will be described below with reference to FIGS. 2 and 3. When the ink ribbon 3 is folded on the side of the rough surface 12 (that is, when the fold extends toward the side of ribbon case 6 that is closest to the rough surface 12), since the smooth surface 13 is folded inside, the ink ribbon is smoothly folded to reach the normal turning position 14, which is defined by the side wall **6*a* of the ribbon case 6. However, when the ink ribbon 3 is folded on the opposite side, i.e. on the side of the smooth surface 13, the rough surface 12 is folded inside and, accordingly, due to the large friction, the ink ribbon 3 is turned back at a position 15 before reaching the normal turning position 14' (shown by a dotted line) which is defined by the opposite side wall 6*b* of the ribbon case. The longer the ink ribbon has been used, the farther away the fold at the position 15 becomes from the side wall 6*b*** and, accordingly, the length of the fold of the ink ribbon becomes shorter and the number of folds of the ink ribbon in the ribbon case increases. As a result, the length of the ribbon case becomes insufficient to contain the increased number of folds of the ink ribbon and, accordingly, the pressure of the feed-in of the ink ribbon increases, and, finally, the feed-in of the ink ribbon becomes impossible.

SUMMARY OF THE INVENTION

It is, therefore, an object of the present invention to provide an ink ribbon folding mechanism for a printing apparatus, in which the ink ribbon can be folded smoothly in the ribbon case, in spite of the roughness of the surface of the ink ribbon.

According to the present invention, this object can be achieved by an ink ribbon folding mechanism of the type described hereinbefore, which is improved in such a way that the contact point of the feed rollers is located in a biased position with respect to the center between the side walls of the ribbon case on the side of the surface of the ink ribbon which is not subjected to a collision with the type.

According to this construction, even though when the ink ribbon is folded on the side of the smooth surface and, accordingly, the ink ribbon is turned back before reaching the normal turning position as described hereinbefore, the turning point of the ink ribbon can reach the side wall of the ribbon case, thereby ensuring a smooth folding of the ink ribbon.

It is preferred that one of the feed rollers, which is in contact with the surface of the ink ribbon subjected to a collision with the type, has a diameter larger than that of the other feed roller. This feature provides a small-sized mechanism and, also, is effective for preventing the ink ribbon in the ribbon case from falling down.

It is also preferred that the ribbon case has an ink ribbon supporting surface, a portion of which, at a certain distance from said ribbon case inlet toward the ribbon case outlet, is an inclined surface which is twisted about an axis extending in the direction of the feed of the ink ribbon. This feature is more effective to prevent the ink ribbon in the ribbon case from falling down.

The present invention will be described below in detail on the basis of preferred embodiments with reference to the accompanying drawings. It should be noted that the same or similar parts or elements illustrated in the drawings are designated by the same reference numerals.

DESCRIPTION OF THE PREFERRED EMBODIMENT

Figure 1:
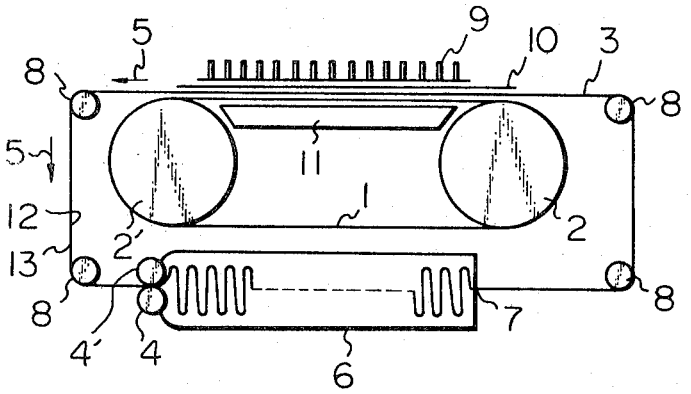
Fig. 1 PRIOR ART
FIG. 1 is a diagrammatic plan view of a conventional line printer.
Figure 2:
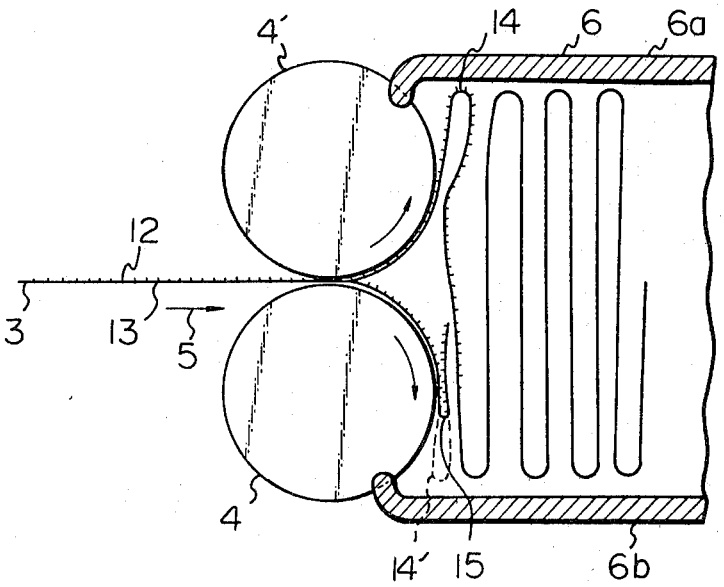
Fig. 2 PRIOR ART
FIG. 2 is a partially sectional plan view of a main portion of a conventional ink ribbon folding mechanism in said line printer.
Figure 3:
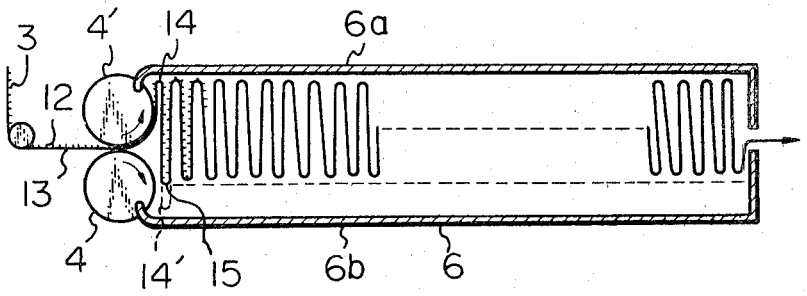
Fig. 3 PRIOR ART
FIG. 3 is a partially sectional plan view of said conventional ink ribbon folding mechanism.
Figure 4:
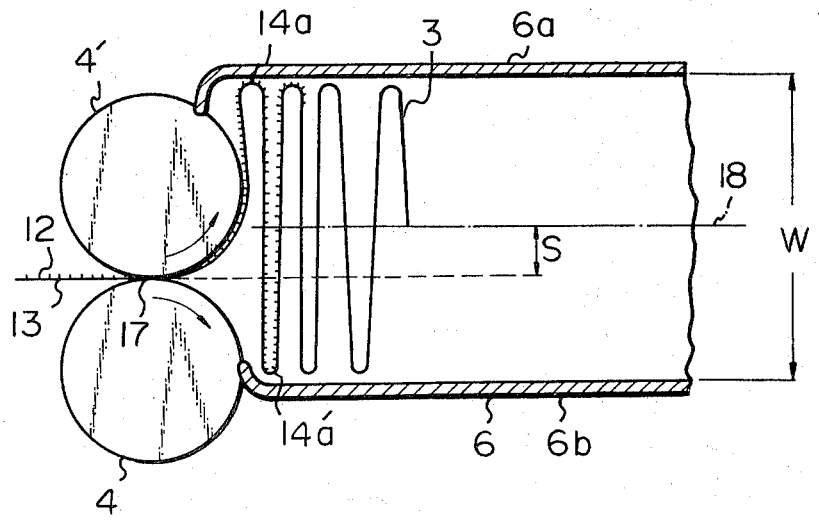
FIG. 4 is a partially sectional plan view of a main portion of an embodiment of an ink ribbon folding mechanism according to the present invention.

Referring to FIG. 4, an embodiment of an ink ribbon folding mechanism according to the present invention comprises an pair of feed rollers 4 and 4', which have diameters equal to each other. These feed rollers 4 and 4' are arranged so that a contact point 17 thereof is located in a biased or offset position with respect to the center 18 between the opposed side walls 6*a* and 6*b* of the ribbon case 6, on the side of the smooth surface 13 of the ink ribbon 3.

It is now assumed that the ink ribbon 3 is fed into the ribbon case 6 by the feed rollers 4 and 4' and, then, folded along the roller 4' on the side of the rough surface 12 of the ink ribbon 3 as illustrated in FIG. 4. In this case, the smooth surface 13 is the inside surface and, accordingly, the ink ribbon 3 can be smoothly folded to reach the side walls 6*a* as shown by reference numeral 14*a*. When the ink ribbon 3 is thereafter folded on the opposite side, i.e. the side of the smooth surface 13, the rough surface 12 is the inside surface and, accordingly, due to the large friction, the ink ribbon is turned back at a position before reaching the normal turning position 14', as described hereinbefore. However, since the contact point of the feed rollers 4 and 4' is located in a position biased toward the side wall 6*b* of the ribbon case 6, the ink ribbon 3 can sufficinetly reach the side wall 6*b* as shown by reference numeral 14*a*'. As a result, even if the surface of the ink ribbon becomes rough, the length of the fold of the ink ribbon does not change and, accordingly, smooth feed-in and feed-out of the ink ribbon can be maintained.

Figure 5:
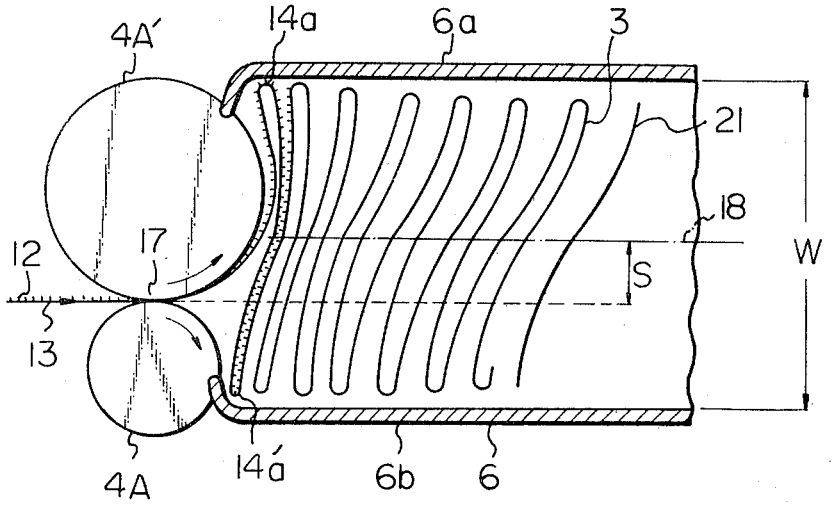
FIG. 5 is a view similar to FIG. 4, but illustrating another embodiment according to the present invention.

Referring to FIG. 5, another embodiment of the present invention comprises a pair of rollers 4A and 4A', which are also arranged so that the contact point 17 thereof is located in a biased position with respect to the center 18 of the ribbon case 6 on the side of the smooth surface 13 of the ink ribbon 3. Furthermore, the feed roller 4A' which contacts the rough surface 12 of the ink ribbon 3 has a diameter larger than that of the other feed roller 4A. Therefore, the length of the fold obtained by the feed roller 4A' is larger than that obtained by the other feed roller 4A. In this embodiment, in the same way as in the embodiment in FIG. 4, the ink ribbon 3 can be smoothly folded to reach the side walls 6*a* and 6*b* as illustrated by reference numerals 14*a* and 14*a*'.

Concerning the embodiments in FIGS. 4 and 5, a practically used design advantageously has the following dimensions, for example: W=74 mm, S=15 mm, D1=42 mm, D2=32 mm and D3=52 mm, wherein "W" is the inner width of the ribbon case 6, "S" is the deviation of the contact point 17 of the feed rollers 4 and 4' or 4A and 4A' with respect to the ribbon case center 18, D1 is the diameter of the feed roller 4 or 4', and D2 and D3 are the diameters of the feed rollers 4A and 4A', respectively.

The embodiment of FIG. 5 mentioned above has further advantages in comparison with the embodiment in FIG. 4. Firstly, the embodiment in FIG. 4 still has a problem in that the feed roller 4, which is on the side on which the feed rollers 4 and 4' are biased, is projected considerably laterally from the ribbon case 6, thereby preventing the mechanism from being made small in size. Contrary to this, in the embodiment in FIG. 5, the projection of the feed roller 4A is small, thereby resulting in a compact shape.

Figure 6:
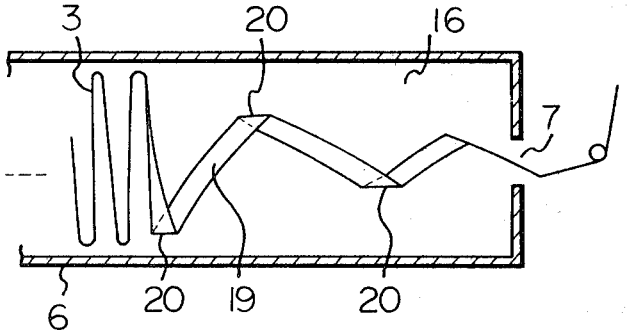
FIG. 6 is a partially sectional plan view used for explanation of another problem in an ink ribbon folding mechanism.
Figure 7:
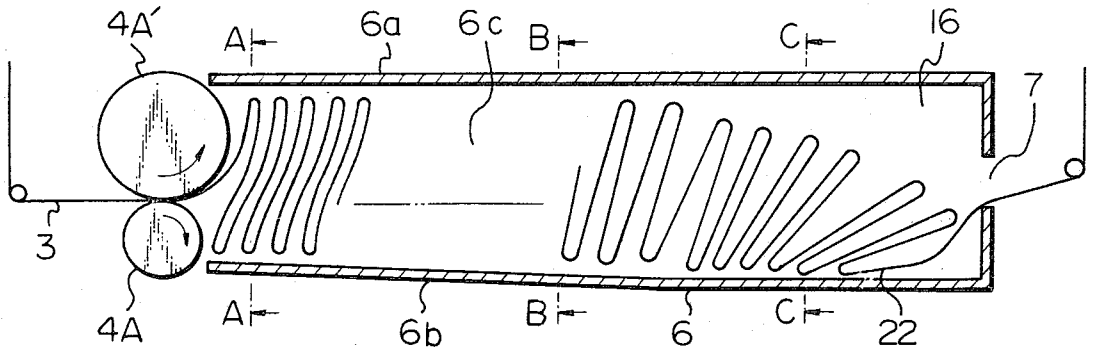
FIG. 7 is a partially sectional plan view of a still another embodiment according to the present invention.
Figure 8C:
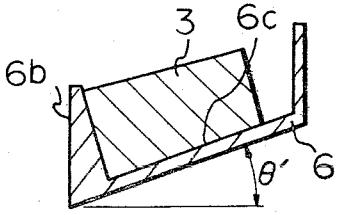
FIGS. 8A, 8B and 8C are sectional views taken along lines A—A, B—B and C—C in FIG. 7, respectively.
Figure 8B:
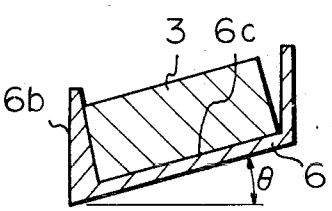
Figure 8A:
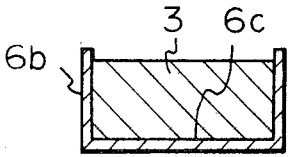

Secondly, the embodiment in FIG. 5 is effective for preventing the ink ribbon from falling down in the ribbon case, as described below. In general, with use, the ink ribbon becomes napped on the surface and becomes thicker and, accordingly, its volume occupying the ribbon case increases gradually. With the increase in volume, the pressure in the ribbon case is increased and, finally, makes it impossible to perform the feed-in of the ribbon. To prevent this phenomenon, the capacity of the ribbon case must be designed to be larger according to the volume of the ink ribbon at the point of time when the life of the ink ribbon is over. Therefore, as illustrated in FIG. 6, when the ink ribbon is fresh, space 16 remains in the ribbon case 6. If the feed of the ink ribbon is performed in this condition, the ink ribbon 3 falls down as designated by reference numeral 19 and, accordingly, overlappings 20 occur. As a result, the ink ribbon 3 comes out of the ribbon case outlet 7 and is fed into the printing station in a twisted condition, thereby producing defects, such as an omission of a letter or inferior printing. Contrary to this, in the embodiment in FIG. 5, each fold of the ink ribbon takes a meandering posture, as symbolically illustrated and designated by reference numeral 21, due to the difference in diameter between the feed rollers 4A and 4A'. This feature makes it difficult for the ink ribbon to fall down and, hence, the ink ribbon can maintain an upstanding posture even though space 16 remains in the ribbon case 6. Therefore, there is little possibility of twisting occurring in the ink ribbon caused by the falling-down of the ribbon as mentioned previously.

Furthermore, FIGS. 7, 8A, 8B and 8C illustrate an embodiment which is better able to prevent the ink ribbon from falling down as mentioned previously. In this embodiment, a portion of a ribbon supporting surface 6C of the ribbon case 6, which is at a certain distance from the ribbon case inlet toward the ribbon case outlet 7, is an inclined surface, as is obvious from FIGS. 8B and 8C, which is twisted about an axis extending in the direction of the feed of the ink ribbon. According to this construction, the ink ribbon 3, as it becomes closer to the ribbon case outlet 7, gradually falls forward so as to rest with the surface against the lower side wall 6*b* of the ribbon case 6, as designated by reference numeral 22 in FIG. 7. Therefore, the ink ribbon 3 maintains an upstanding posture so as to prevent overlappings 20 as mentioned before (FIG. 6) from being formed and, as a result, the ink ribbon can be fed out of the ribbon case outlet 7 in the normal condition without twists.

Meanwhile, it is required that an ink ribbon, after being used for a certain amount of time, be replaced with a new one. In general, for the replacement of the ink ribbon, an ink ribbon packed in a case (hereinafter referred to as "ribbon pack") is used. However, in the operation of inserting the new ink ribbon in the printing machine, if the ink ribbon is carelessly drawn, the ink ribbon comes too loosely out of the ribbon pack, thereby making the succeeding operation very hard to perform. Therefore, it is necessary that a means be provided for pinching the ink ribbon, so as to prevent if coming loosely out of the ribbon pack. Furthermore, there is also a need for a means of pinching the ink ribbon so as to give a tension to the ink ribbon which is being taken out of the ribbon case and fed into the printing station in the printing operation. However, the former one of the two ribbon pinching means mentioned above is not required to operate except for the ink ribbon inserting operation, and the latter one is not required to operate except for the printing operation. In view of this point, it is advantageous in construction, operation and manufacturing cost, to provide the ink ribbon folding mechanism with a brake system, which includes two ink ribbon pinching devices and is adapted to operate them alternatively. An embodiment of the ink ribbon folding mechanism with such a brake system will be described below, with reference to FIGS. 9 through 12.

Figure 9:
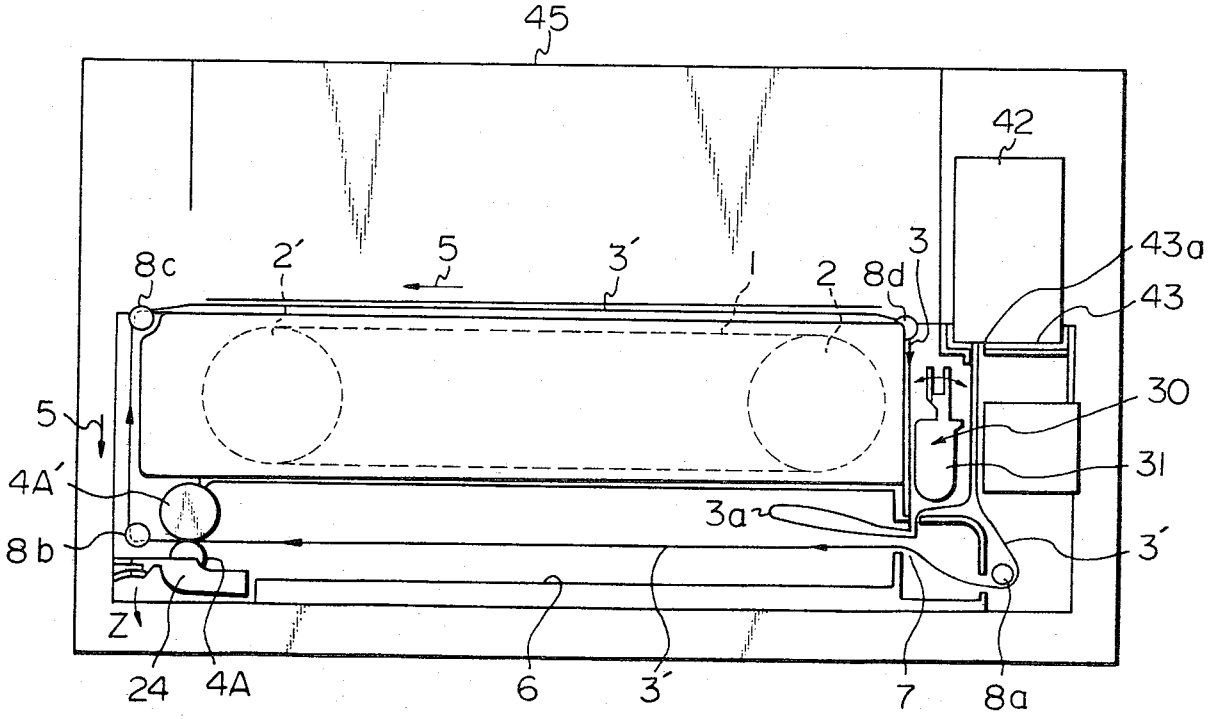
FIG. 9 is a diagrammatic plan view of a line printer equipped with a further embodiment of the ink ribbon folding mechanism according to the present invention, illustrating a state of setting of an ink ribbon.
Figure 10:
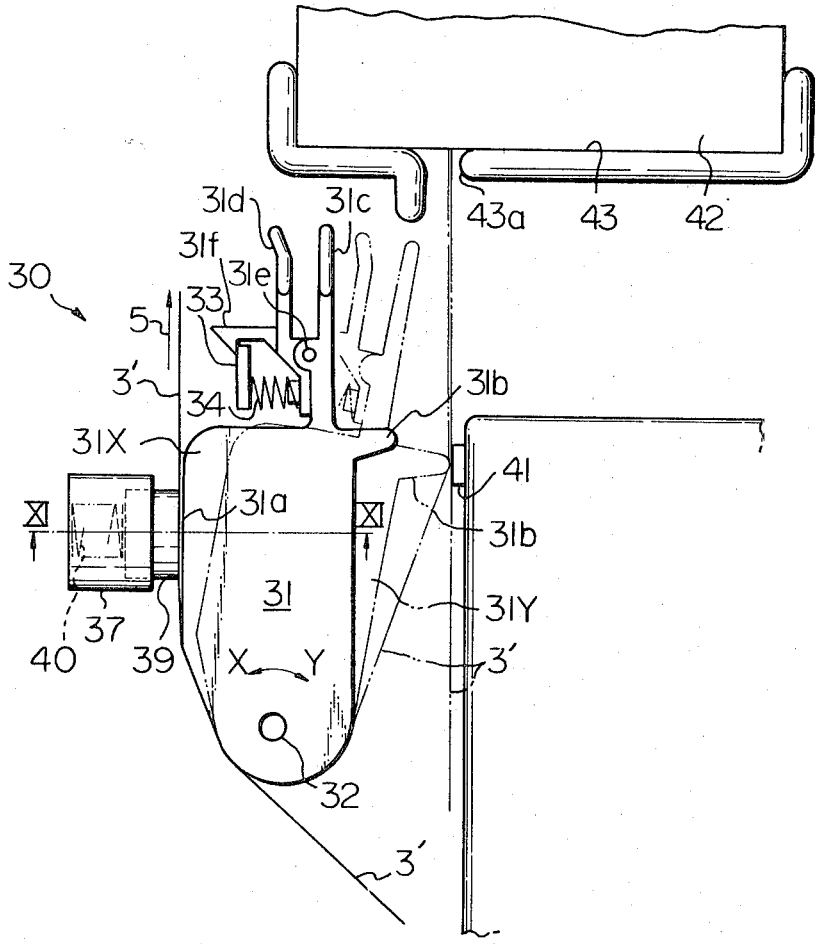
FIG. 10 is a diagrammatic plan view of a brake system in the embodiment in FIG. 9.
Figure 11:
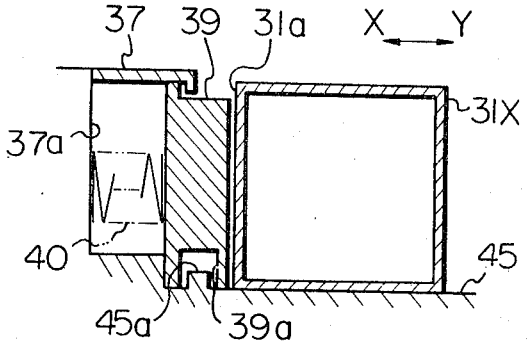
FIG. 11 is a vertical sectional view taken along line XI—XI in FIG. 10.

Referring to FIGS. 9, 10 and 11, reference numeral 30 designates generally a brake system, and reference numeral 45 designates a frame of a line printer. The brake system 30 is disposed adjacent to the outlet 7 of the ribbon case 6, and includes a brake arm 31. The brake arm 31 is attached to the frame 45 by means of a pin 32 and is movable between a first position 31X illustrated by the solid line and a second position 31Y illustrated by the phantom line, as shown by arrows X and Y in FIG. 10. The brake arm 31 has a brake surface 31*a* and a brake projection 31*b* on the opposed sides and, also, has a lever 31*c* at the free end, to which a lever 31*d* is pivotally connected by means of pin 31*e*. The lever 31*d* has a pawl 31*f* which is adapted for engagement with a stopper 33 secured to the frame 45. A coil spring 34 is provided between the lever 31*d* and the stopper 33 for applying constant pressure to the brake arm 31 via the lever 31*d* in the direction of the arrow Y.

Opposed to the brake surface 31*a* of the brake arm 31 is a brake shoe 39, which is movably connected to a housing 37 which is, in turn, secured to the frame 45. For limiting excessive movement of the brake shoe 39, a recess 39*a* is formed in the lower portion, into which a projection 45*a* formed on the frame 45 is inserted as shown in FIG. 11. A coil spring 40 is provided between the brake shoe 39 and the housing inner wall 37*a* for applying constant pressure to the brake shoe 39 in the direction of the arrow Y. The brake surface 31*a* of the brake arm 31 and the brake shoe 39 form a first ink ribbon pinching device, which is used in the printing operation as mentioned hereinafter.

Furthermore, a cushion member 41 is secured to the frame 45 opposite to the brake projection 31*b* of the brake arm 31. The cushion member 41 is made of an elastic material, such as a rubber. The brake projection 31*b* and the cushion member 41 form a second ink ribbon pinching device, which is used in the ink ribbon inserting operation as mentioned hereinafter.

Figure 12:
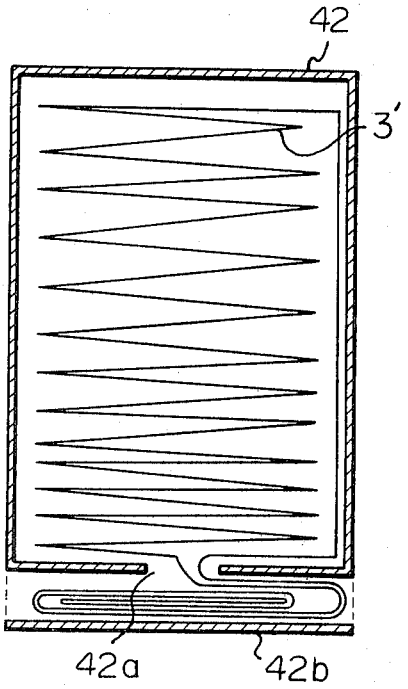
FIG. 12 is a sectional plan view of a ribbon pack.

The frame 45 is provided with a stage 43, on which a ribbon pack 42 is mounted. As illustrated in FIG. 12, in the ribbon pack 42, a new ink ribbon 3' is contained in such a state that a leading portion adjacent to an outlet 42*a* and having a length of about 2 m, for example, is folded with double plies and the remaining greater portion is folded with a single ply. The leading portion of the ink ribbon 3' is held by a folding flap 42*b* which is connected to the back wall of the body of the ribbon pack 42. The stage 43 is provided with an opening 43*a*, through which the ribbon 3' can be taken out toward the ribbon case 6.

The replacement of the ink ribbon is performed as follows. Firstly, the used ink ribbon is removed from the ribbon case 6 and the ink ribbon feeding route, and also the ribbon pack 42 is mounted on the stage 43 as illustrated in FIGS. 9 and 10. The brake arm 31 is held in the first position 31X. Then, the end of the leading portion of the new ink ribbon 3' is taken out of the ribbon pack 42 through the outlet 42*a* and the opening 43*a* and, then, inserted between the brake arm 31 and the cushion member 41, as illustrated by the phantom line in FIG. 10. Subsequently, the lever 31*d* of the brake arm 31 is operated so that the pawl 31*f* disengages from the stopper 33, whereby the brake arm 31 is moved by the action of the coil spring 34 to the second position 31Y. As a result, the second ink ribbon pinching means operates to pinch the ink ribbon 3' between the brake projection 31*b* and the cushion member 41. On the other hand, the first ink ribbon pinching means ceases to operate, with a clearance being brought into existence between the brake surface 31*a* and the brake shoe 39. In this state, the leading portion of the ink ribbon 3' is gradually taken out of the ribbon pack 42 and, as illustrated in FIGS. 9 and 10, routed through the guide roller 8*a*, the ribbon case 6, the feed rollers 4A and 4A', the guide rollers 8*b*, 8*c* and 8*d*, and the clearance between the brake arm 31 and the brake shoe 39. It should be noted that, when the ink ribbon 3' is passed through the feed rollers 4A and 4A', the roller 4A can be kept apart from the roller 4A' by operating the lever 24 in the direction of arrow Z. In this ink ribbon inserting operation, even if the ink ribbon 3' is carelessly drawn, the ink ribbon never comes loosely out of the ribbon pack 42, because the ink ribbon 3' is pinched between the brake projection 31*b* and the cushion member 41.

After the ink ribbon inserting operation, the brake 31 is returned to the first position 31X and held in place with the pawl 31*f* engaging the stopper 33. Accordingly, the first ink ribbon pinching means operates to pinch the ink ribbon 3' between the brake surface 31*a* and the brake shoe 39, while the second ink ribbon pinching means ceases to operate. In this state, for preventing the ink ribbon 3' from being twisted and slackening, an excessive length 3*a* of the ink ribbon 3' is previously taken into the ribbon case 6, as illustrated in Fib. 9. Thereafter, the feed rollers 4A and 4A' are operated so as to feed the ink ribbon 3' in the direction of arrow 5, so that the ink ribbon 3' is taken out of the ribbon pack 42 and, then folded in the ribbon case 6. In this case, since the ink ribbon 3' taken out of the ribbon pack 42 is passed through the printing station and fed into the ribbon case, it is possible to have the printing station operate simultaneously with the starting of the feed rollers 4A and 4A', so as to perform the printing operation. Therefore, the transfer of the ink ribbon from the ribbon pack to the ribbon case can be performed automatically during the printing operation and, accordingly, a particular period of time for the transfer of the ink ribbon is not required. It is, of course, possible to perform the transfer of the ink ribbon only, without performing the printing operation. Finally, the empty ribbon pack 42 is removed from the stage 43, and the replacement of the ink ribbon is finished.

It should be appreciated that the present invention has been described above in detail with particular reference to the preferred embodiments thereof, but variations and modifications can be made thereto within the spirit and scope of the present invention set forth in the claims.

What is claimed is:

1. An improved ink ribbon folding mechanism for a printing apparatus of the type wherein a ribbon case provided with side walls and a ribbon supporting surface at the bottom thereof, which define a ribbon supporting portion, and with an inlet and an outlet at opposite ends of said ribbon supporting portion, said ribbon supporting portion being adapted for temporarily storing a portion of an endless loop of ink ribbon that is withdrawn from the outlet of the ribbon case and circulated through a printing station where one side of the ink ribbon is subjected to collision with type before the ink ribbon is returned to the ribbon case through the inlet thereof, and a pair of feed rollers having parallel axes of rotation are disposed adjacent each other at said inlet of said ribbon case so that the ink ribbon returning to the ribbon case is pinched between said feed rollers and fed into said ribbon storing portion alternately along the peripheries of the feed rollers so as to be folded regularly by lengths reaching the opposite side walls of the ribbon case and to be forwarded in the ribbon storing portion to the outlet of the ribbon case, wherein the improvement comprises:

(a) that the point at which said feed rollers pinch the ink ribbon is located in a biased position with respect to a line running along the center between the opposite side walls of the ribbon case, on the side of the ribbon case that is the closest to the surface of the ink ribbon which is not subjected to collision with the type;

(b) that the feed roller which is in contact with the surface of the ink ribbon subjected to collision with the type has a larger diameter than that of the other feed roller;

(c) that the outermost portion of said other feed roller, said outermost portion being opposite to said point of pinching of the ink ribbon with respect to the axis of said other feed roller, is positioned further from said center line than the distance from said center line to the inner surface of the side wall of the ribbon case that is closest to the surface of the ink ribbon which is not subjected to collision with the type;

(d) that said feed roller which is in contact with the surface of the ink ribbon subjected to collision with the type protrudes on both sides of said other roller, so that lines drawn perpendicular to the center line and tangent to said feed roller which is in contact with the surface of the ink ribbon subjected to collision with the type do not pass through said other roller; and (e) that said ribbon supporting surface of the ink ribbon case has an end region adjacent the inlet of the ribbon case which is substantially horizontal and has an end region adjacent the outlet of the ribbon case which is inclined with respect to the horizontal, with the intermediate region between said end regions being twisted about said center line and with the angle of inclination between the horizontal and the ribbon supporting surface increasing from one end region to the other so as to connect said end regions.

2. An ink ribbon folding mechanism according to claim 1 further comprising brake means disposed adjacent to said outlet of the ribbon case and including first means for pinching the ink ribbon as it is circulated to the printing station; and second means, which is different from said first means, for pinching a new ink ribbon as it is installed in the printing apparatus, said brake means being adapted to cause said first and second ink ribbon pinching means to be operated alternatively.

3. An ink ribbon folding mechanism according to claim 2, wherein said brake means comprises: a brake arm disposed adjacent to said outlet of the ribbon case and pivotally movable between first and second positions, said brake arm having a brake surface and a brake projection; a brake shoe adapted to cooperate with said brake surface of the brake arm so as to pinch the ink ribbon therebetween when the brake arm is moved into said first position; and a cushion member adapted to cooperate with said brake projection of the brake arm, so as to pinch the ink ribbon therebetween when the brake arm is moved into said second position, said brake shoe and brake surface comprising said first ink ribbon pinching means, said cushion member and brake projection comprising said second ink ribbon pinching means.

* * * * *

UNITED STATES PATENT AND TRADEMARK OFFICE

CERTIFICATE OF CORRECTION

PATENT NO. : 4,451,165

DATED : May 29, 1984

INVENTOR(S) : Toshiharu Fudatsuji et al

It is certified that error appears in the above-identified patent and that said Letters Patent is hereby corrected as shown below:

Column 1, line 12, "facing" should be -- folding --.

Column 4, line 45, after "fresh," insert -- a --.

Column 5, line 24, "if" should be -- it --.

line 44, "a" (first occurrence) should be -- the --.

Column 8, line 32, after "l" ineert --,--.

Signed and Sealed this

*Twelfth* Day of *February 1985*

[SEAL]

*Attest:*

DONALD J. QUIGG

*Attesting Officer*

*Acting Commissioner of Patents and Trademarks*